US007820083B2

(12) United States Patent
Bjorklund

(10) Patent No.: US 7,820,083 B2
(45) Date of Patent: Oct. 26, 2010

(54) WET REFLECTIVE PAVEMENT MARKING AND METHOD

(75) Inventor: Mark S. Bjorklund, Midland, GA (US)

(73) Assignee: Fortson-Peek Company, Inc., Columbus, GA (US)

( * ) Notice: Subject to any disclaimer, the term of this patent is extended or adjusted under 35 U.S.C. 154(b) by 423 days.

(21) Appl. No.: 12/029,074

(22) Filed: Feb. 11, 2008

(65) Prior Publication Data

US 2009/0202298 A1 Aug. 13, 2009

(51) Int. Cl.

| | |
|---|---|
| ***B29D 11/00*** | (2006.01) |
| ***B29B 9/06*** | (2006.01) |
| ***B28B 17/00*** | (2006.01) |
| *G02B 5/136* | (2006.01) |

(52) U.S. Cl. ..... 264/1.9; 264/2.6; 264/69; 264/139; 264/142; 264/143; 264/148; 264/162; 264/172.11; 264/178 R; 264/210.3; 264/210.4; 264/210.8; 264/211; 264/211.14; 264/211.23; 264/245; 264/293; 264/294; 264/296; 264/341; 359/530; 359/534; 359/542; 359/546; 359/547; 404/14; 404/16; 40/903

(58) Field of Classification Search ..... None
See application file for complete search history.

(56) References Cited

U.S. PATENT DOCUMENTS

| | | | | |
|---|---|---|---|---|
| 3,114,597 | A * | 12/1963 | Lee | 264/1.9 |
| 3,225,123 | A * | 12/1965 | Wiswell | 264/1.9 |
| 3,418,896 | A | 12/1968 | Rideout | |
| 3,664,242 | A * | 5/1972 | Harrington et al. | 404/77 |
| 3,901,614 | A | 8/1975 | Overacker | |
| 4,072,403 | A * | 2/1978 | Eigenmann | 359/535 |
| 4,136,991 | A | 1/1979 | Clark et al. | |
| 4,148,561 | A | 4/1979 | Eigenmann | |
| 4,279,534 | A | 7/1981 | Eigenmann | |
| 4,288,487 | A | 9/1981 | Eigenmann | |
| 4,388,359 | A | 6/1983 | Ethen et al. | |
| 4,455,344 | A * | 6/1984 | Matsuyama et al. | 428/327 |
| 4,469,645 | A * | 9/1984 | Eigenmann | 264/1.6 |
| 4,572,703 | A | 2/1986 | Moller | |
| 4,573,763 | A | 3/1986 | Thomas | |
| 4,607,978 | A | 8/1986 | Eigenmann | |
| 4,613,632 | A | 9/1986 | Aliani et al. | |
| 4,627,950 | A * | 12/1986 | Matsui et al. | 264/103 |
| 4,652,172 | A | 3/1987 | Eigenmann | |
| 4,681,480 | A | 7/1987 | Eigenmann | |
| 4,758,469 | A | 7/1988 | Lange | |
| 4,810,431 | A * | 3/1989 | Leidner | 264/15 |
| 4,983,458 | A | 1/1991 | Dejaiffe | |
| 4,988,555 | A | 1/1991 | Hedblom | |
| 5,039,557 | A | 8/1991 | White | |
| 5,108,218 | A | 4/1992 | Wyckoff | |
| 5,227,221 | A | 7/1993 | Hedblom | |
| 5,318,604 | A | 6/1994 | Gorsuch et al. | |
| 5,407,615 | A * | 4/1995 | Norville | 264/36.1 |
| 5,593,246 | A | 1/1997 | Hedblom et al. | |

(Continued)

*Primary Examiner*—Jeffrey Wollschlager
(74) *Attorney, Agent, or Firm*—Thomas, Kayden, Horstemeyer & Risley, LLP

(57) ABSTRACT

Reflective pellets (16) are formed by extrusion of reflective micro beads (26) in a thermoplastic (20), removal of the surface layer of the pellets so as to expose the reflective beads at the surface of the pellets and applying the reflective pellets to the base line (14) of the striping applied to a paved road.

17 Claims, 3 Drawing Sheets

U.S. PATENT DOCUMENTS 5,650,213 A * 7/1997 Rizika et al. ..... 428/143
5,676,488 A 10/1997 Hedblom
5,763,000 A 6/1998 Hedblom
5,774,265 A 6/1998 Mathers et al.
5,835,271 A * 11/1998 Stump et al. ..... 359/529
5,897,914 A 4/1999 DePriest
5,941,655 A 8/1999 Jacobs et al.
6,217,252 B1 * 4/2001 Tolliver et al. ..... 404/77
6,326,053 B1 12/2001 Stump et al.
6,412,957 B1 7/2002 Oba
6,482,519 B1 * 11/2002 Schleifstein ..... 428/406
6,913,824 B2 * 7/2005 Culler et al. ..... 428/401
7,597,826 B1 * 10/2009 Rabinowitz et al. ..... 264/1.6
2003/0031850 A1 * 2/2003 Scharnke et al. ..... 428/221
2005/0100709 A1 5/2005 Bescup et al.
2008/0101859 A1 5/2008 Chen

* cited by examiner

WET REFLECTIVE PAVEMENT MARKING AND METHOD

TECHNICAL FIELD

This disclosure concerns a reflective pavement marking that includes raised pellets in a base line that are effective in reflecting light in both dry and wet conditions and the reflectivity is renewable as the surfaces wear away.

BACKGROUND

It is common in traffic control to use pavement markings for directing vehicles. Typically, solid lines or skip lines are formed on the surface of pavement to guide the drivers of vehicles in safe traffic flow arrangements.

In order to make the pavement striping more visible in darkness, reflective beads have been added to the striping. In wet night time conditions the reflectivity of the road striping is substantially reduced because of the presence of water on the road striping. The water tends to block the light from engaging and being reflected from the beads, making the road conditions hazardous. This hazardous condition may be aggravated because the drivers may be used to having adequate reflection of the headlights for directing the drivers in the proper lanes.

It is known that incorporating vertical surfaces in pavement markings improves the visibility of the marking and the reflex reflectivity of the marking, particularly in wet atmospheric conditions. Regular flat striping is hard to see when wet for several reasons. For example, when 30 meter geometry is applied, where the vehicle lights are 30 meters away from the reflective surface, Schnell's laws of defraction and Fresnell's laws of reflection dictate that about 85% of the light from the headlights is reflected off the surface of the water and does not even reach the reflective striping. Also, of the 15% of the light that is refracted into the water and reflected back, only 28% will be refracted back into the air. If the line was a perfect reflector, only about 4% of the original light would make it back to the eyes of the driver of the vehicle. By incorporating a vertical surface within the line, over 98% of the light is transmitted to the vertical reflecting surface, and 98% of the reflected light refracts back into the air.

The vertical profiles have been achieved by imprinting protrusions in the baseline marking before the base line material has been cured, or by adding the protrusions to the baseline marking before it has cured. Also, reflective protrusions have been developed by coating a core product with adhesive and subsequently dunking the core product in molten glass, or mixing the coated core product in small spherical glass beads. Another example is disclosed in U.S. Pat. No. 6,326,053 in which protuberances are formed in the base line marking and optical elements are partially embedded in the protuberances.

The beads that are used to reflect light may be translucent and therefore retro-reflective, or the beads may be formed of reflective material. This is effective particularly when the beads are elevated above the pavement surface so that they are not submerged in wet conditions.

The pavement markings can be formed in patterns that have some significance to the vehicle operators, such as different formations of striping and skip lines. The arrangement of the striping in the lane of the vehicle may be formed so that when the wheels roll over the striping the wheels tend to vibrate or "rumble", or the striping may be formed so as to direct the driver of the vehicle with arrows or other direction symbols.

One of the problems of the prior art elevated reflective striping is that the materials of the striping wear away over time due to environmental conditions and particularly due to engagement by the wheels of vehicles on the striping. The reflective beads tend to become loose and eventually separated from the striping, thereby diminishing the amount of reflection provided by the striping. Even when the reflective beads are partially embedded in the striping, the beads tend to become loose and separate from the striping.

Other markings that have a renewable reflective structure tend to have a period of poor reflectivity between the time when the reflective surface has been damaged or lost and other beads have not yet been properly exposed. And the processes for making the reflective markings as described above are expensive.

Thus, this invention addresses the problems of the prior art described above and provides improved reflective pellets for reflective marking of highways, the process of making the pellets, and highway striping that includes the pellets.

SUMMARY OF THE INVENTION

The present invention provides improved road striping for highways over which vehicles pass, including raised reflective pellets that tend to provide better reflection over a longer period of time.

One form of the invention is a process of making reflective pellets for reflective marking of highways, with the process including forming a mixture of molten thermoplastic and reflective beads, the extrusion of the mixture to form an extrudate, dividing the extrudate into lengths to form the plastic extrudate into pellets, each of which contain a plurality of the plastic beads. The pellets may be cooled in liquid until the pellets become solid. The surface of the cured thermoplastic material that forms the body of the pellet may be removed so as to provide more exposure of the beads at the surface of the pellets. This provides the surface beads with enough exposure to reflect light.

Another feature of the invention is that the pellets are formed with microscopic reflective beads, both internally and at the surface thereof, so that wear at the surface of the pellets tends to expose more of the reflective beads. As the beads are lost due to wear on the pellets the beads next under the lost beads will become exposed for continued reflection by the pellets.

Another aspect of the invention includes the process of forming the reflective beads, which includes immersing the pellets in a dissolving liquid that dissolves and removes the thermoplastic material at the surface of the pellets so as to expose the reflective beads.

Another form of the invention includes the process of removing the material at the surface of the pellets to expose the reflective beads at the surface of the pellets, including agitating the pellets in a dissolving liquid.

Another aspect of the invention may be bonding of the pellets to the base line, which includes fusing the thermoplastic material of the pellets to the material of the base line.

Other objects, features and advantages of the present invention will become apparent upon reading the following specification, taken in conjunction with the accompanying drawings.

DETAILED DESCRIPTION

Figure 1:
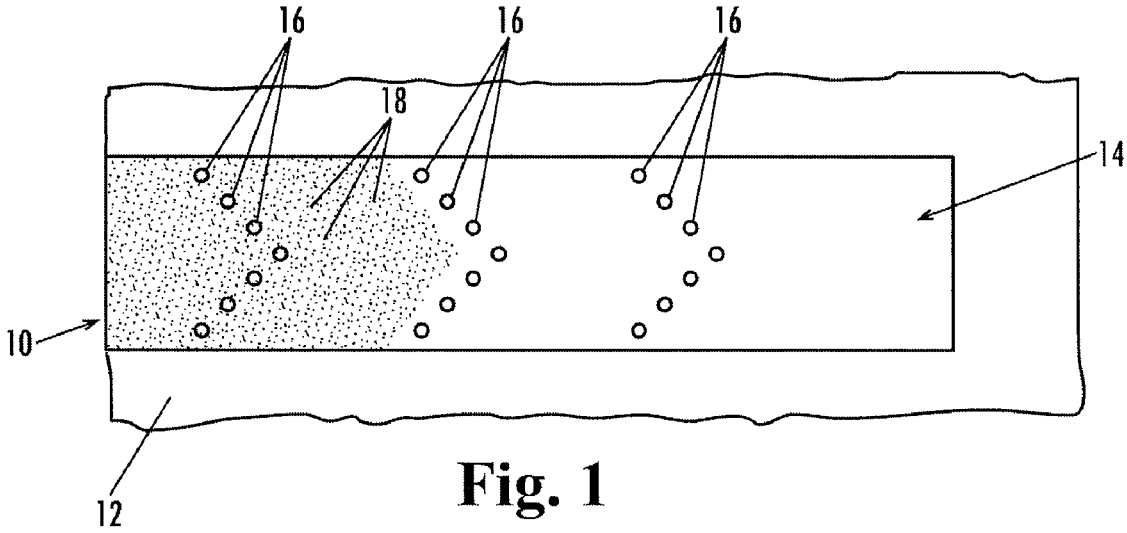
FIG. 1 is a plan view of the highway striping, partially completed, showing the process of applying the reflective material to the highway.

Referring now in more detail to the drawings, in which like numerals indicate like parts throughout the several views, FIG. 1 illustrates an example of partially completed road striping that is formed by the present invention. The road striping is applied to a paved road, such as a concrete or an asphalt paved road 12 and includes a base line 14, reflective pellets 16, and reflective beads 18. The pellets are shown in more detail in FIGS. 4 and 7. Preferably, both the reflective pellets 16 and reflective beads 18 are substantially spherical so that they are flowable under the influence of gravity through hoppers and other equipment employed in handling them in the process of manufacturing the striping of FIG. 1.

The pellets may be manufactured by formulating a thermoplastic with appropriate pigment, a glass or ceramic microsphere loading of 50-75% and a binder system specifically tailored to be soluble in a particular solvent. This provides the pellets with a substantially predetermined bead count and a substantially consistent composition of both the beads and the thermoplastic throughout its body. For example a pellet may be 5 centimeters in diameter and contain approximately 14,158 micro reflective beads. Other amounts of beads may be present in the pellets, depending of the density of the beads in the extrudate from which the pellets are formed, the size of the pellets, the size of the beads, etc. The compound is then extruded and pelletized with equipment common in the plastic industry, into a substantially spherical pellet. This forms the body 20 of the pellets 16. The reflective beads 22 are embedded in the body 20 of the pellets, with the surface beads 24 partially embedded so that a substantial amount of the surfaces of these beads are exposed. Preferably, the reflective beads 22 are microspheres of glass or ceramic that are retroreflective and have a diameter of about 0.015 to 0.06 cm. Reflective beads of other sizes may be used, and a mixture of sizes of beads and of varying refractive indexes of beads may be used. Micro-spherical beads 22 are available from Flex-o-Lite, Inc. of St. Louis, Mo.

The reflective beads 18 that are imbedded in the base line may be the same as or different from the reflective beads 22 that are imbedded in the pellets.

Figure 7:
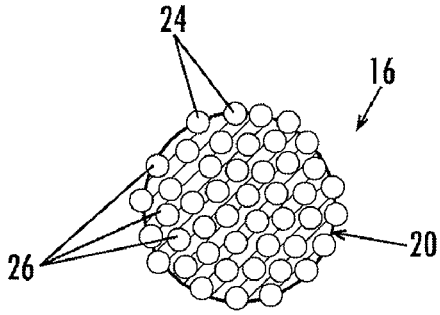
FIG. 7 is a cross sectional view of a reflective pellet.

FIG. 7 is a cross section of a pellet 16. The pellets 16 include not only the surface beads 24 but also the internal beads 26 that are not initially exposed at the surface of the pellets. The spherical body 20 that is formed of the thermoplastic material surrounds the internal beads 26.

Figure 5:
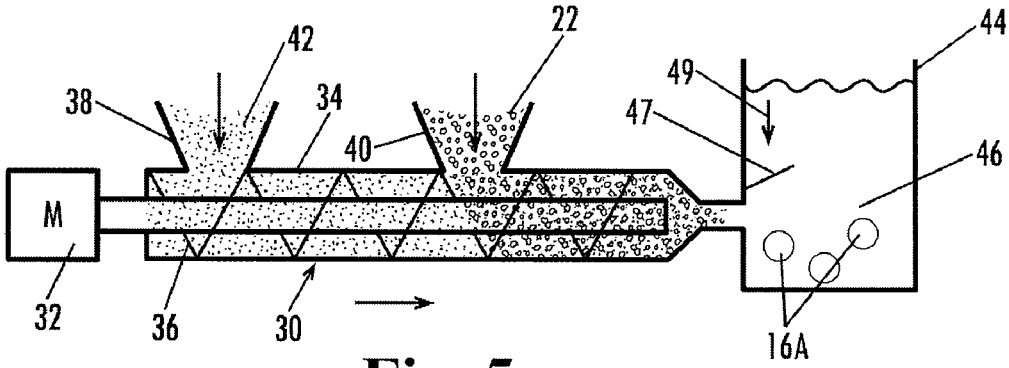
FIG. 5 is a side schematic view of the extruder that forms the reflective pellets.

As shown in FIG. 5, the reflective pellets 16 are formed by extrusion. A thermoplastic, such as mixture of polyvinyl butyral resin, a pigment, and a plasticizer are fed to the extruder 30. The extruder includes a motor 32, a housing 34, and one or more augers 36 extending through the housing, with an entrance 38 formed at one end of the housing. A second entrance 40 is located downstream from the first entrance 38. The thermoplastic mixture is fed through the first entrance 38 to the auger 36, and the mixture is heated, thoroughly mixed and advanced along the length of the housing 34. The reflective beads 22 are fed through the second entrance 40 and become thoroughly mixed with the now molten thermoplastic mixture. The preferred ratio by volume of the thermoplastic mixture to the reflective beads is approximately 2:3. Other ratios may be used in accordance with the desired properties of the end product. An extruder suitable for the production of the pellets is available from Krauss-Maffei Corp. of Florence, Ky. under the brand name of Berstorff Model ZE-40.

The molten mixture of thermoplastic 42 and reflective beads 24 is extruded into a container 44 filled with a cooling liquid 46. A knife 47 moving in a rotary path 49 cuts the oncoming extrudate so that it is divided into equal lengths in an unfinished spherical pellet form 16A as shown in FIG. 5. Preferably, the pellets are cut so that length of the pellets is the same as the breadth of the pellets. The pellets 16A include the reflective beads 22, but the beads generally are covered with the thermoplastic material at this stage so that the beads are not exposed well enough to be effective in reflecting light. The pellets 16A in the cooling liquid tend to become substantially spherical during this process due to the cutting action of the rotary cutter, the turbulence of the cooling liquid and the inertia forces on the pellets. The pellets may be formed and cooled in a Gala 6 brand underwater pelletizer, available from Gala Industries, Inc. of Eagle Rock, Va.

The cooling liquid, such as water, cools the molten thermoplastic of the pellets so that the thermoplastic becomes solid and hard, with the reflective beads 22 captured internally of the body 20 of the beads.

Figure 6:
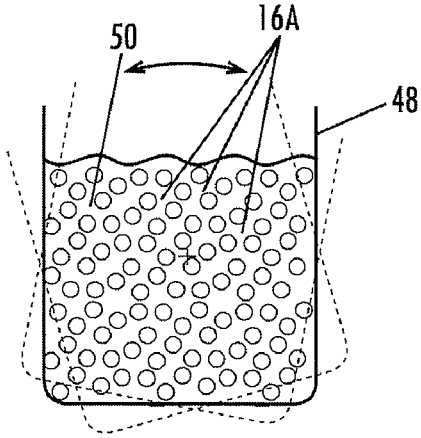
FIG. 6 is a side cross sectional view of an example of an agitator used to reduce the thermoplastic material at the surface of the pellets.

The now solid, cooled pellets 16A are transferred to an agitator, such as agitator 48 of FIG. 6. The agitator is filled with both the pellets and a dissolving liquid 50 such as glycol ether, butylcellosolv, or isopropanol alcohol. These and possibly other dissolving liquids are used to dissolve the exposed outer surface of the thermoplastic body 20 of the pellets 16A, with the agitation by the agitator 48 causing vigorous contact between the pellets 16A and the dissolving liquid 50. The length of time for agitating the beads 16A can be controlled so as to remove a predetermined amount of the surface material from the pellets. Also, the concentration of the dissolving liquid may be adjusted for the same effect.

Figure 4:
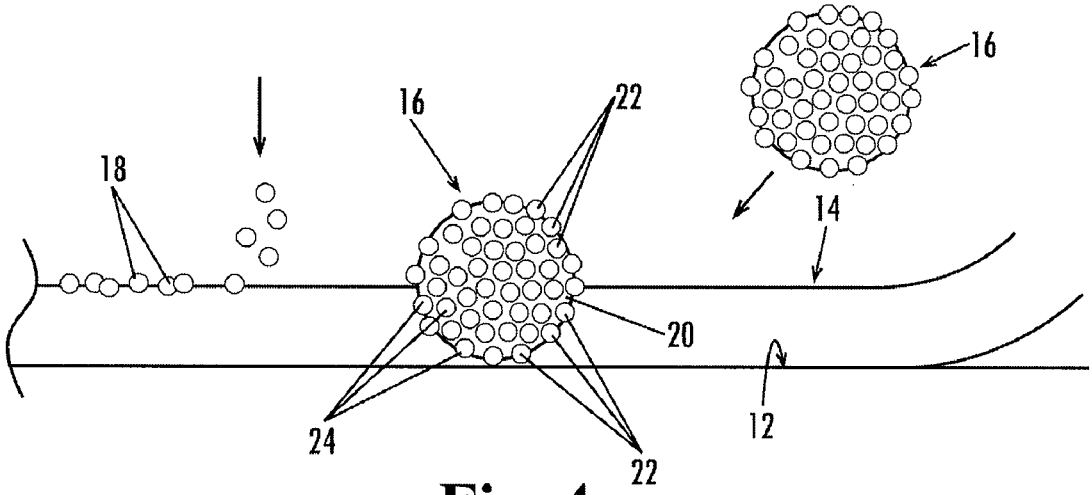
FIG. 4 is a side elevational view, in cross section, of the highway striping, showing the process of applying the pellets and beads to the striping, and showing an example of the dimensions of the pellets with respect to the thickness of the striping.

After the agitation cycle has been completed, the pellets are removed from the agitator 48, and the thermoplastic body 20 of the pellets will have been reduced in diameter so that the reflective beads 22 at the surface of the body 20 are exposed and protrude from the body, as shown in FIG. 4. In the meantime, the internal beads 26 remain covered by the body 20. The pellets usually are washed and allowed to dry before the next processing step.

Because the pellets are effectively "pre-worn" by the chemicals and agitation, there should be no period of poor reflectivity once placed in service.

Should the external surface of the pellets be deteriorated and worn away, the wearing away of the body 20 exposes the internal beads 26 (FIG. 8). Thus, the wear on the reflective pellets 16 effectively renews the reflectivity of the pellets by exposing the internal beads 26.

The following are examples of the make up of reflective pellets made in accordance with this invention:

Example 1

| | |
|---|---|
| Highway glass spheres AASHTO M247 specification: | 44% |
| 1.9 refractive index 100/150 sieve glass spheres | 20% |
| Titanium Dioxide Pigment | 1% |
| Yellow 83 Pigment | 0.5% |
| Butvar B98 Polyvinylbutyral polymer | 34.5% |

Example 2

| | |
|---|---|
| Highway glass spheres AASHTO M247 specification: | 30% |
| 1.9 refractive index 100/150 sieve glass spheres | 35% |
| Titanium Dioxide Pigment | 8% |
| Butvar B76 Polyvinylbutyral polymer | 26.8% |
| S-2076 Plasticizer | 0.2% |

Example 3

| | |
|---|---|
| Highway glass spheres AASHTO M247 specification: | 20% |
| 1.9 refractive index 100/150 sieve glass spheres | 40% |
| Titanium Dioxide Pigment | 8% |
| Butvar B98 Polyvinylbutyral polymer | 22% |
| Santotac Recycled PVB | 10% |

Example 4

| | |
|---|---|
| 1.9 refractive index 100/150 sieve glass spheres | 60% |
| Titanium Dioxide pigment | 8% |
| Maleic modified Glycerol ester of rosin | 5% |
| Butvar B98 | 27% |

Butvar B76, B98, S-2075 plasticizer, and Santotac Recycled PVB are products of Solutia, Inc.

Example 5

| | |
|---|---|
| 1.9 refractive index 100/150 sieve glass spheres | 30% |
| 2.2 refractive index 100 plus sieve glass spheres | 35% |
| Elvacite 2016 acrylic resin | 30% |
| Titanium Dioxide pigment | 5% |

Elvacite acryilic resin is a product of Lucite, Intl.

Figure 2:
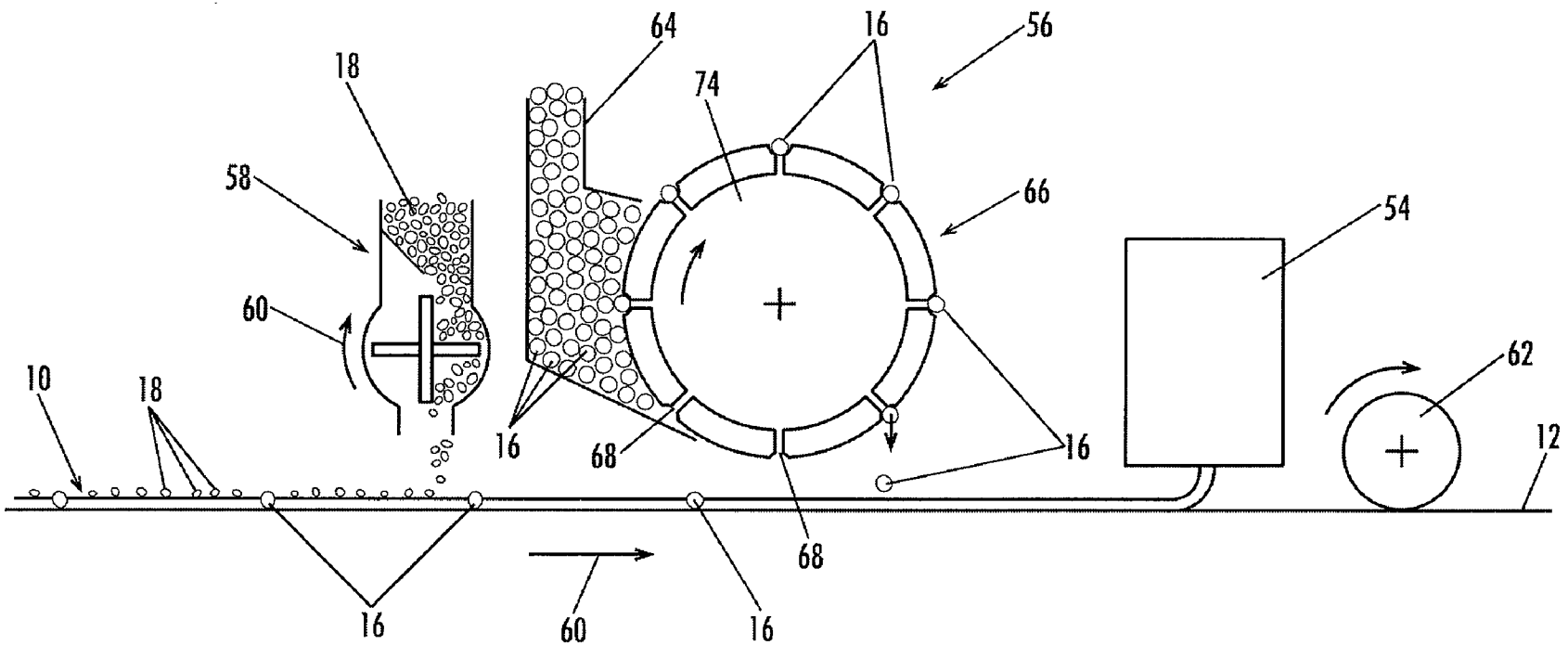
FIG. 2 is a side elevational schematic view of the process for forming the highway striping.

FIG. 2 shows the process of applying the reflective pellets to the base line 11 of the road striping 10. The base line is formed of a thermoplastic material from a dispenser 54 which is conventional in the art. The base line is molten thermoplastic, such as polyvinyl butyral resin, a pigment, and a plasticizer, and may be substantially the same material as the body 20 of the reflective pellets 16. The base line dispenser 54, the pellet dispenser 56, and the bead dispenser 58 all may be mounted on a single vehicle such as a truck manufactured by Mark Rite Lines in Billings Mont., Model 4-4000-DP that moves these elements in unison across the paved road 12 in the direction as indicated by arrow 60. A timing wheel 62 is carried by the vehicle and controls the timing of dispensing of the base line 11 and the rate of dispensing the reflective pellets 16, and reflective beads 18. The raw materials used for the base line may be a thermoplastic pavement marking material such as Tuffline Alkyd manufactured by Crown Technology, LLC and glass spheres such as Thermobrite beads manufactured by Flex-o-lite of St. Louis Mo.

The thermoplastic for the base line is added to a kettle on the truck and heated to approximately 400-425° F. where it becomes molten and acts as a pourable liquid. It is pumped from the kettle to the application gun where it is extruded or sprayed onto the road surface in the form of a line of specified width, typically 6 inches wide, and thickness of approximately 0.1 inch. Immediately behind the application gun is the pellet dispenser 56 and immediately behind the pellet dispenser is the bead dispenser 58 which randomly sprinkles the glass beads 18 onto the surface of the molten plastic where they are partially embedded to varying depths where they become mechanically entrapped upon cooling and solidification of the base line.

Figure 3:
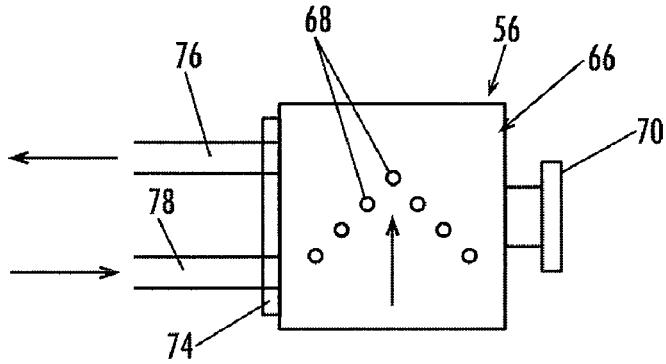
FIG. 3 is a front view of the pellet dispenser used in the process illustrated in FIG. 2.

The reflective pellets 16 are placed in a hopper 64 that feeds to a rotary pellet dispensing drum 66, shown in FIGS. 2 and 3. The pellet dispensing drum rotates in response to the rate of advancement of the timing wheel 62 and includes surface openings 68, a drive sprocket 70 that rotates the pellet dispensing drum in the direction as indicated by arrow 72, and a stationary end wall 74. A vacuum opening 76 is formed through the stationary end wall 74 and a pressure opening 78 is also formed through the same stationary end wall. These openings are in communication with compressors (not shown) that create the desired pressures within the pellet dispensing drum. As shown in FIG. 2, there is an internal baffle 80 that separates the high pressure below the baffle from the low pressure above the baffle within the pellet dispensing drum 66.

As the pellet dispensing drum rotates in the direction as indicated by arrow 72, air is withdrawn through the vacuum opening 76 above the internal baffle 80 and air is supplied through the pressure opening 78 to move air into the pellet dispensing drum below the internal baffle 80. This has the effect of drawing the reflective pellets 16 that are in the hopper 64 above the pellet dispensing drum 66 into the surface openings 68. The surface openings 68 are sized to be smaller than the reflective pellets 16. This has the effect of causing the reflective pellets 16 to cling to the exterior surface of the pellet dispensing drum at the surface openings 68 as the surface openings 68 pass beneath the hopper 64. As the pellet dispensing drum rotates farther along its circular path, it carries the reflective pellets 16 to the lower portion of the pellet dispensing drum where the higher pressure received from the pressure opening 78 below the internal baffle 80 discharges the reflective pellets onto the base line 14.

As shown in FIG. 3, the surface openings 68 are formed in a predetermined configuration so that the reflective pellets are discharged in a pattern onto the base line 14. The configuration of pellets on the base line can be changed by changing the configuration of the surface openings 68, as may be desired.

As shown in FIG. 2, after the reflective pellets 16 have been applied as described above, the bead dispenser 58 passes over the area of the base line 11 where the pellets have already been dispensed. The bead dispenser is also conventional in the art. As schematically shown, the beads are deposited on the facing surface of the base line 14 so that a dense layer of beads becomes partially embedded in the still soft base line 14.

As shown in FIG. 4, the reflective pellets 16 are formed with a diameter that is approximately twice the breadth as the depth of the base line 14. The pellets tend to sink into the molten base line down to where the pellets are likely to engage the facing surface of the paved road 12 so that there is substantially no hazard of the reflective pellets being fully submerged in the base line.

As shown in FIG. 4, the reflective beads 18 also become partially embedded in the surface of the base line 14. The weight of the reflective beads 18 usually is not enough to cause them to be fully submerged in the base line. The dispenser may be placed far enough away from the molten plastic applicator so that the line has cooled sufficiently to prevent the beads from sinking all the way. Also, the temperature of the base line may be controlled to some extent so as to regulate the penetration of the reflective beads and reflective pellets into the base line.

The reflective beads 18 that are distributed on the surface of the base line 14 may be the same or may be different from the reflective beads 22 that are embedded in the pellets 16.

As shown in FIG. 4, the reflective beads 22 that are submerged in the base line 14 tend to protrude into the base line, tending to anchor the reflective beads in the base line. Also, there is direct contact between the thermoplastic of the pellets and the molten base line, causing the pellets to become fused to the base line.

For an optimum effect of the road striping, the reflective pellets should be spaced apart between about 3 centimeters and about 6 centimeters along the length of the paved road. Since the reflective pellets 16 protrude higher from the road striping than the reflective beads 18, the greater spacing between the reflective pellets minimizes the amount of shadowing of the reflective beads 18 by the reflective pellets and allows for more light impingement upon the reflective beads 18 distributed between the pellets.

The thermoplastic material from which the body 20 of the reflective pellets 16 are made may be formed of other thermoplastics, including acrylic resin, polyvinyl butyral resin, polycarbonates and poly olefins.

Although preferred embodiments of the invention have been disclosed in detail herein, it will be obvious to those skilled in the art that variations and modifications of the disclosed embodiments can be made without departing from the spirit and scope of the invention as set forth in the following claims.

The invention claimed is:

1. A process of making reflective pellets for reflective marking of highways, comprising:

forming a mixture of thermoplastic, a pigment and a plasticizer, heating the mixture to a molten state, progressively moving the heated mixture through a die to form a plastic extrudate, as the heated mixture approaches the die progressively adding reflective beads to the mixture such that the plastic extrudate formed by the die includes a plurality of the reflective beads, immersing the plastic extrudate in a cooling liquid, while the plastic extrudate is immersed in the cooling liquid cutting the plastic extrudate into lengths approximately the same as the breadth of the plastic extrudate to form the plastic extrudate into pellets that contain a plurality of the reflective beads, cooling the pellets with the cooling liquid until the pellets become solid, immersing the solid pellets in a dissolving liquid that dissolves the plastic extrudate at the surface of the solid pellets, and agitating the pellets in the dissolving liquid for dissolving the exposed surfaces of the pellets and for exposing the reflective beads at the surfaces of the pellets.

2. The process of claim 1, wherein said dissolving liquid is selected from a group consisting essentially of glycol ether and isopropanol.

3. The process of claim 1, wherein the reflective beads are selected from the group consisting essentially of glass and ceramic.

4. The process of claim 1, wherein the step of heating the mixture to a molten state comprises heating the mixture to a temperature greater than 350° F.

5. The process of claim 1, wherein the reflective beads are substantially spherical.

6. The process of claim 1, wherein the pellets are substantially spherical and each of the pellets includes a plurality of the reflective beads.

7. The process of claim 1, and further including the step of partially embedding the pellets in a base line of a molten thermoplastic pavement marking of a highway surface with some of the reflective beads exposed from the base line, and bonding the pellets to the base line.

8. The process of claim 7, wherein the step of bonding the pellets to the base line comprises fusing the pellets to the base line.

9. The process of claim 1, wherein the thermoplastic material is polyvinyl butyral resin and the ratio by volume of the mixture of polyvinyl butyral resin, a pigment and a plasticizer to the reflective beads is approximately 4 to 6.

10. The process of claim 1, wherein the step of forming a mixture of a thermoplastic material, a pigment and a plasticizer, comprises forming a mixture in which the thermoplastic material is selected from the group consisting of: polyvinyl chloride, acrylic resin, polyvinyl butyral, polycarbonate, and polyolefin.

11. A process of making reflective pellets for reflective marking of highways, comprising:

forming a mixture of molten thermoplastic and reflective beads, progressively moving the mixture through a die to form an extrudate, dividing the plastic extrudate into lengths to form the plastic extrudate into pellets each of which contain a plurality of the reflective beads, cooling the pellets until the pellets become solid, and removing the thermoplastic at the surface of the pellets to expose the reflective beads at the surface of the pellets, wherein the step of removing the thermoplastic at the surface of the pellets to expose the reflective beads at the surface of the pellets comprises immersing the pellets in a dissolving liquid that dissolves the thermoplastic at the surfaces of the pellets.

12. The process of claim 11 wherein the step of immersing the pellets in a dissolving liquid comprises immersing the pellets in a dissolving liquid selected from the group consisting essentially of glycol ether, butylcellosolv and isopropanol alcohol.

13. The process of claim 11, wherein the step of removing the thermoplastic at the surface of the pellets to expose the reflective beads at the surface of the pellets includes agitating the pellets in the dissolving liquid.

14. The process of claim 11, wherein the reflective beads are selected from the group consisting essentially of glass and ceramic.

15. The process of claim 11, wherein the step of heating the mixture to a molten state comprises heating the mixture to a temperature greater than 380° F.

16. The process of claim 11, wherein the step of forming a mixture of molten thermoplastic and reflective beads includes forming the mixture with substantially spherical beads.

17. The process of claim 11, and further including the step of partially embedding the pellets in a base line of a molten thermoplastic pavement marking of a highway surface with portions of the reflective beads exposed from the base line.

* * * * *